US010446131B2

(12) United States Patent
Ivey et al.

(10) Patent No.: US 10,446,131 B2
(45) Date of Patent: Oct. 15, 2019

(54) PRINTABLE DIFFUSER

(71) Applicant: Mitek Corp., Inc., Phoenix, AZ (US)

(72) Inventors: Johnathan Ivey, Chandler, AZ (US); Kevin Sykes, Phoenix, AZ (US)

( * ) Notice: Subject to any disclaimer, the term of this patent is extended or adjusted under 35 U.S.C. 154(b) by 0 days.

(21) Appl. No.: 15/902,446

(22) Filed: Feb. 22, 2018

(65) Prior Publication Data

US 2019/0088238 A1 Mar. 21, 2019

Related U.S. Application Data

(63) Continuation-in-part of application No. 15/710,654, filed on Sep. 20, 2017, now Pat. No. 10,237,636.

(51) Int. Cl.

| | |
|---|---|
| ***H04R 1/02*** | (2006.01) |
| ***G10K 11/00*** | (2006.01) |
| ***B41M 5/00*** | (2006.01) |
| ***G10K 11/20*** | (2006.01) |
| ***H04R 11/02*** | (2006.01) |

(52) U.S. Cl.

CPC ..... *G10K 11/002* (2013.01); *B41M 5/0058* (2013.01); *B41M 5/0082* (2013.01); *G10K 11/20* (2013.01); *H04R 11/02* (2013.01)

(58) Field of Classification Search

CPC ..... H04R 1/02

See application file for complete search history.

(56) References Cited

U.S. PATENT DOCUMENTS

| | | | | |
|---|---|---|---|---|
| 3,779,336 | A * | 12/1973 | Bertagni | H04R 7/04 181/174 |
| 4,926,962 | A * | 5/1990 | Graham | B29C 37/0053 181/150 |
| 5,115,882 | A * | 5/1992 | Woody | H04R 1/345 181/144 |
| 5,521,983 | A * | 5/1996 | Thompson, III | H03G 5/00 381/94.1 |
| 6,142,254 | A * | 11/2000 | Claybaugh | H04R 1/023 181/141 |
| 6,738,483 | B1 * | 5/2004 | Betts | H04R 1/345 381/160 |
| 2004/0129492 | A1 * | 7/2004 | Bertagni | H04R 1/02 181/150 |
| 2005/0008173 | A1 * | 1/2005 | Suzuki | H04R 1/345 381/160 |

(Continued)

*Primary Examiner* — Olisa Anwah

(74) *Attorney, Agent, or Firm* — Keith L. Jenkins, Registered Patent Attorney, LLC; Keith L. Jenkins

(57) ABSTRACT

A sound diffuser for a ceiling speaker system having a downward-facing (when installed) flat disc cover plate and a flat barrel flange that assists in clamping a ceiling tile. The downward facing surfaces of the disc cover plate and a flat ring releasably attached to, and covering, the barrel flange are printable surfaces. The ring and the disc are magnetically attractable and are held in place with magnets. The ring and the disc cover plate can be rotated to align patterns printed on the ring and the disc cover plate to align to a pattern on the ceiling and to each other. Three-dimensional printing of the ring and/or the disc cover plate is included. The diffuser is preferably used in conjunction with the SMALL CEILING SPEAKER SYSTEM of U.S. patent application Ser. No. 15/710,654, the entire contents of which are incorporated herein by reference.

20 Claims, 7 Drawing Sheets

(56) References Cited

U.S. PATENT DOCUMENTS

| | | | | |
|---|---|---|---|---|
| 2006/0177088 | A1* | 8/2006 | Howard | H04R 1/023<br>381/391 |
| 2008/0044053 | A1* | 2/2008 | Belanger | H04R 1/023<br>381/391 |
| 2013/0028463 | A1* | 1/2013 | Baker | H04R 1/023<br>381/391 |
| 2013/0251181 | A1* | 9/2013 | Stewart, Jr. | H04R 1/025<br>381/332 |
| 2017/0078810 | A1* | 3/2017 | Lee | H04R 27/00 |

* cited by examiner

PRINTABLE DIFFUSER

This application is a continuation in part of application Ser. No. 15/710,654, now U.S. Pat. No. 10,237,636 issued Mar. 19, 2019, filed Sep. 20, 2017 by at least one common inventor.

FIELD OF ART

The present invention relates to a sound diffuser for a ceiling-mounted audio system in which only the sound diffuser is visible below the ceiling. The present invention more particularly relates to a sound diffuser that can be printed upon to match a ceiling surface pattern.

BACKGROUND OF THE INVENTION

Ceiling-mounted speakers are frequently used in office complexes and schools. While a variety of audio systems above the ceiling have been developed, the appearance of ceiling speakers has not changed in decades. While size may vary, typical ceiling speakers still look, from the point of view of people in the room below the ceiling, the same as they have for decades: a frame surrounding a speaker grill. This monotony limits the options of architects and interior designers in creating comfortable spaces.

SUMMARY OF THE INVENTION

Briefly described, the invention includes a sound diffuser having a downward-facing (when installed) flat disc cover plate and a flat barrel flange that assists in clamping a ceiling tile. The downward facing surfaces of the disc cover plate and a flat ring releasably attached to, and covering, the barrel flange are printable surfaces. The ring and the disc cover plate are preferably steel and are held in place with magnets. The ring and the disc cover plate can be rotated to align patterns printed on the ring and the disc cover plate to align to a pattern on the ceiling and to each other. Three-dimensional printing of the ring and/or the disc cover plate is included. The diffuser is preferably used in conjunction with the SMALL CEILING SPEAKER SYSTEM of U.S. patent application Ser. No. 15/710,654, the entire contents of which are incorporated herein by reference.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

As used an defined herein directional words such as "down," "downward," "up", "upper," "top", "bottom", etc. are referenced to the operational orientation of the invention. As used and defined herein, "printed", and its derivative words, refers to a physical layer of one or more colorants on at least a portion of a surface.

Figure 1:
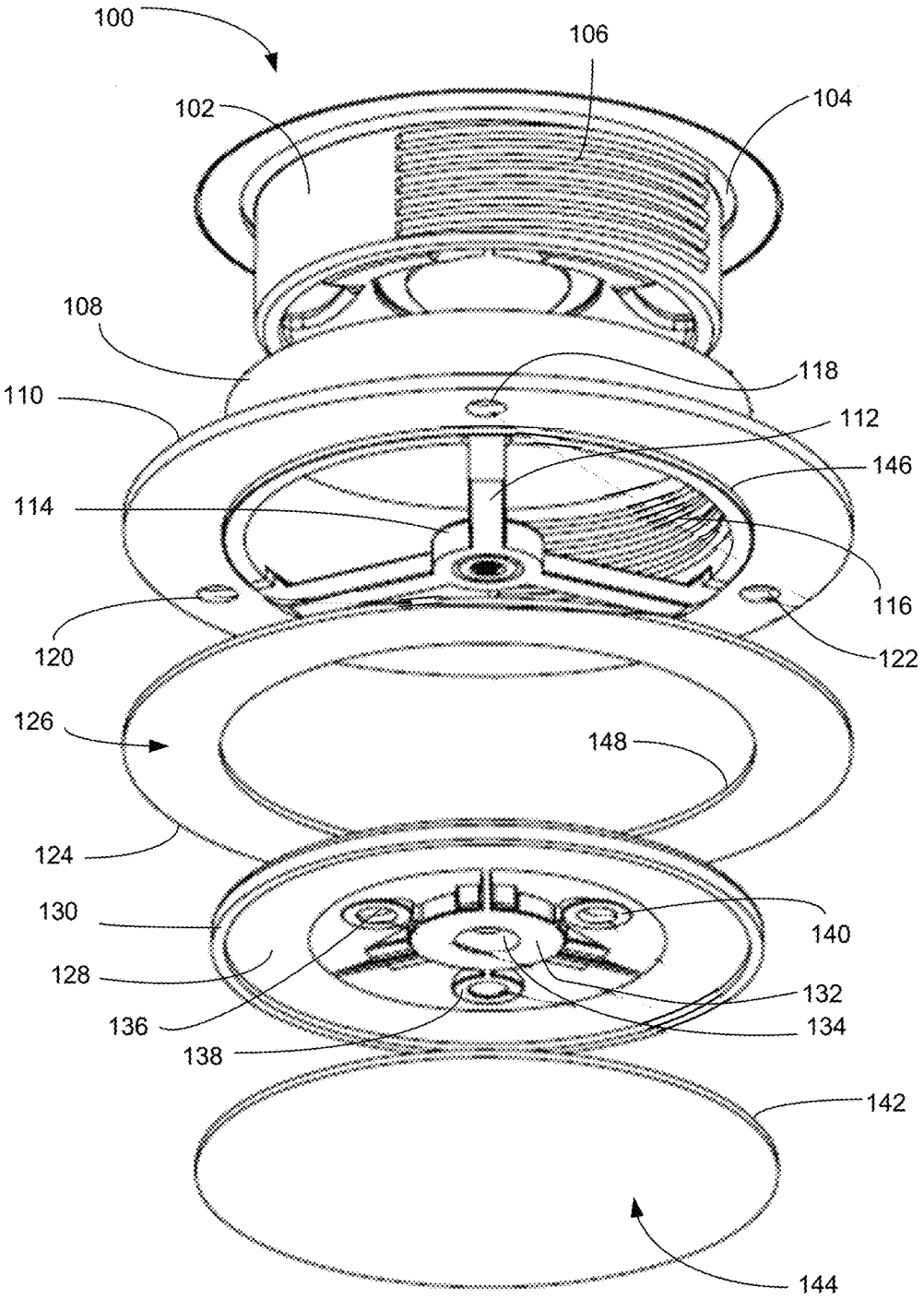
FIG. 1 is an exploded side perspective view illustrating an exemplary embodiment of the printable diffuser, according to a preferred embodiment of the present invention.

FIG. 1 is an exploded side perspective view illustrating an exemplary embodiment of the printable diffuser 100, according to a preferred embodiment of the present invention. Acoustic channel shell 102 protrudes through opening 104 to engage diffuser barrel 108 with partial shell threads 106 engaging, as the user determines, partial barrel threads 118. Diffuser barrel 108 includes a threaded hub 114 supported by arms 112 (one of three labeled) and an inner downwardly extending rim 146. Diffuser barrel 108 includes a flat annular bottom perimeter flange 110 that supports barrel magnet cups 118, 120, and 122 that fixedly receive magnets to retain steel ring 124. Steel ring 124 has an inner perimeter 148 that slidingly engages downwardly extending rim 146 when steel ring 124 is rotated. The bottom surface 126 of steel ring 124 is a printable surface. The bottom side of diffuser body 128 has a central hub 132 with threads 134 that align, during assembly, with threads in barrel hub 114. The bottom side of diffuser body 128 includes a downward perimeter rim 130 and diffuser magnet cups 136, 138, and 140, each of which fixedly receives a diffuser magnet 402 (see FIG. 4) to retain steel disc cover plate 142. Steel disc cover plate 142 includes a printable bottom surface 144.

Acoustic channel shell 102 is preferably made of injection molded plastic. Diffuser barrel 108 and diffuser body 128 are also preferably made of injection molded plastic. The magnets 402 are preferably rare earth magnets 402. While the ring 124 and the disc 142 are preferably made of steel, in various other embodiments, respective other magnetically attractable materials with printable surfaces (including composites) may be used. In various embodiments, respective various materials that meet the functional requirements of the preferred materials may be used.

Figure 2:
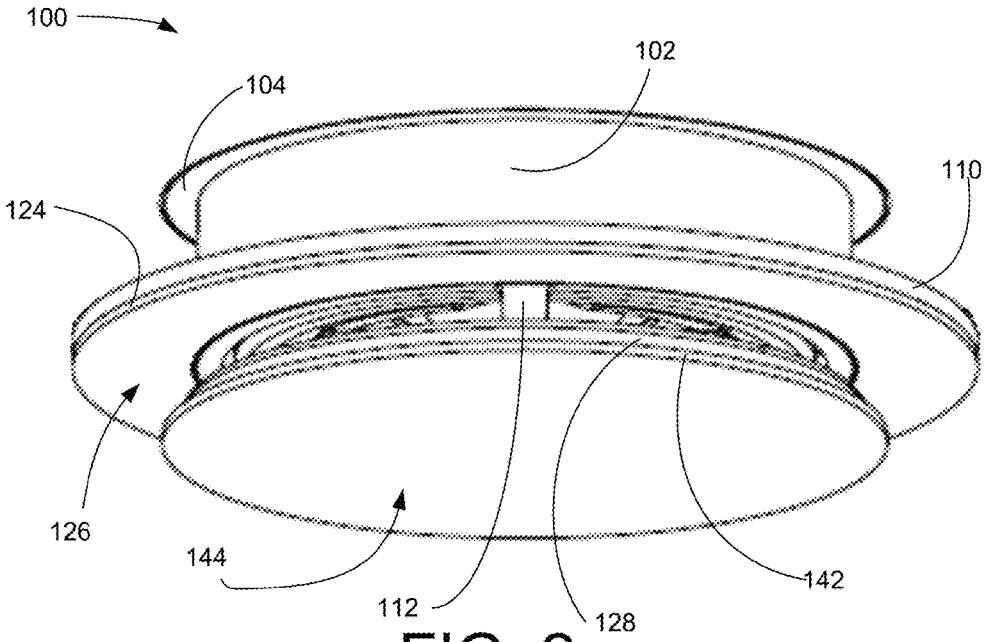
FIG. 2 is a bottom-side perspective view illustrating the exemplary embodiment of the printable diffuser of FIG. 1, according to a preferred embodiment of the present invention.

FIG. 2 is a bottom-side perspective view illustrating the exemplary embodiment of the printable diffuser 100 of FIG. 1, according to a preferred embodiment of the present invention. Steel ring 124 is shown magnetically attached to flange 110. The advantage of the magnetic attachment is that ring 126 can be manually rotated around downwardly extending rim 146 to align a complex pattern on the printable surface 126 to a pattern on the ceiling. Steel disc cover plate 142 is magnetically and releasably attached to diffuser body 128. The advantage of the magnetic attachment is that steel disc cover plate 142 may be manually rotated to align a pattern on bottom surface 144 of the disc cover plate with a pattern on the steel ring bottom surface 126 and/or a pattern on the ceiling.

Figure 3:
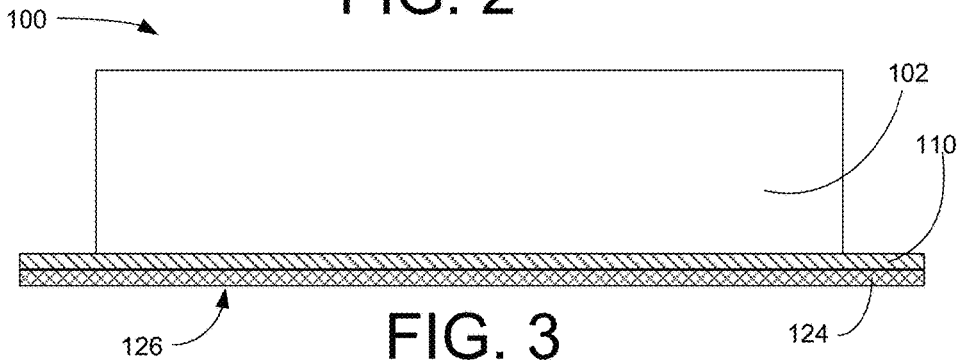
FIG. 3 is a side elevation diagrammatic view illustrating the exemplary embodiment of the printable diffuser of FIG. 1, according to a preferred embodiment of the present invention.

FIG. 3 is a side elevation diagrammatic view illustrating the exemplary embodiment of the printable diffuser 100 of FIG. 1, according to a preferred embodiment of the present invention. Steel ring 124 is magnetically attached to bottom perimeter flange 110.

Figure 4:
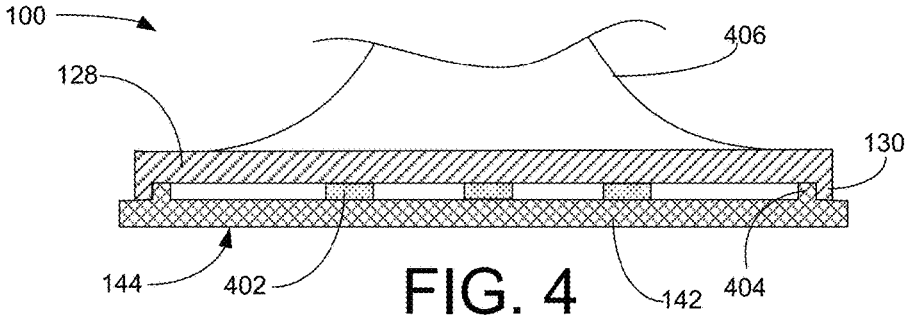
FIG. 4 is a side elevation diagrammatic view illustrating the exemplary embodiment of the printable diffuser of FIG. 1, according to a preferred embodiment of the present invention.

FIG. 4 is a side cross sectional diagrammatic view illustrating the exemplary embodiment of the printable diffuser 100 of FIG. 1, according to a preferred embodiment of the present invention. Diffuser body 128 has an outer perimeter rim 130 which slidingly engages circular ridge 404 on top of steel disc cover plate 142. Magnets 420 (one of three labeled) are fixedly attached to diffuser body 128. The rim 130 and ridge 404 prevent steel disc cover plate from sliding off center.

Figure 5:
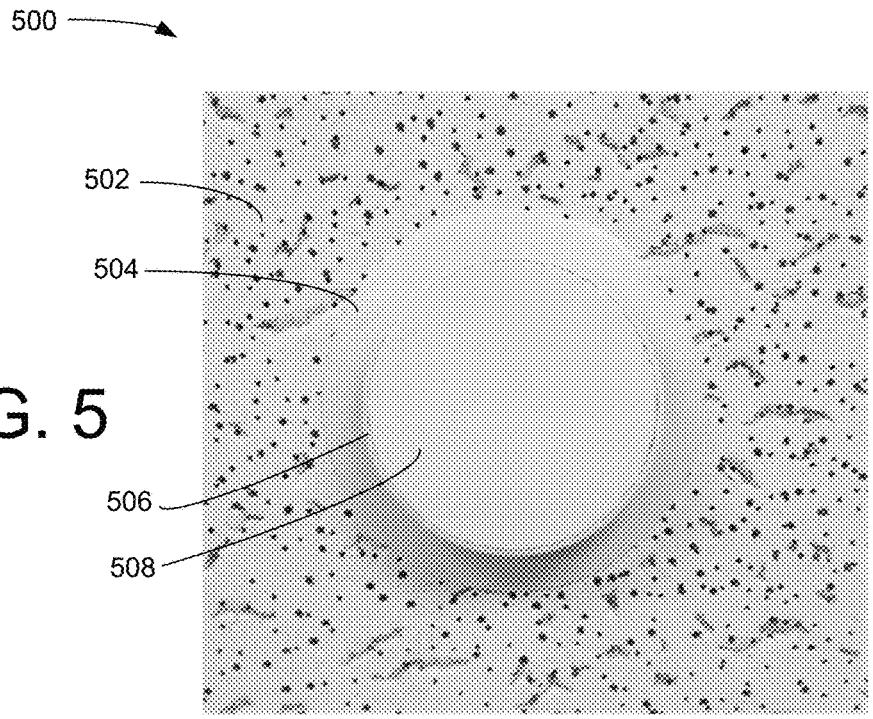
FIG. 5 is a bottom plan view illustrating the exemplary embodiment of an exemplary diffuser, according to a preferred embodiment of the present invention.

FIG. 5 is a bottom plan view illustrating the exemplary embodiment of an exemplary diffuser 500, according to a preferred embodiment of the present invention. Diffuser 500 is made according to U.S. patent application Ser. No. 15/710,654 to the same inventor. Ceiling tile 502 has a pattern, as shown. Barrel rim 504 is radially curved and disc cover plate 508 rests entirely within rim 506. Diffuser 500 is included here for comparison.

Figure 6:
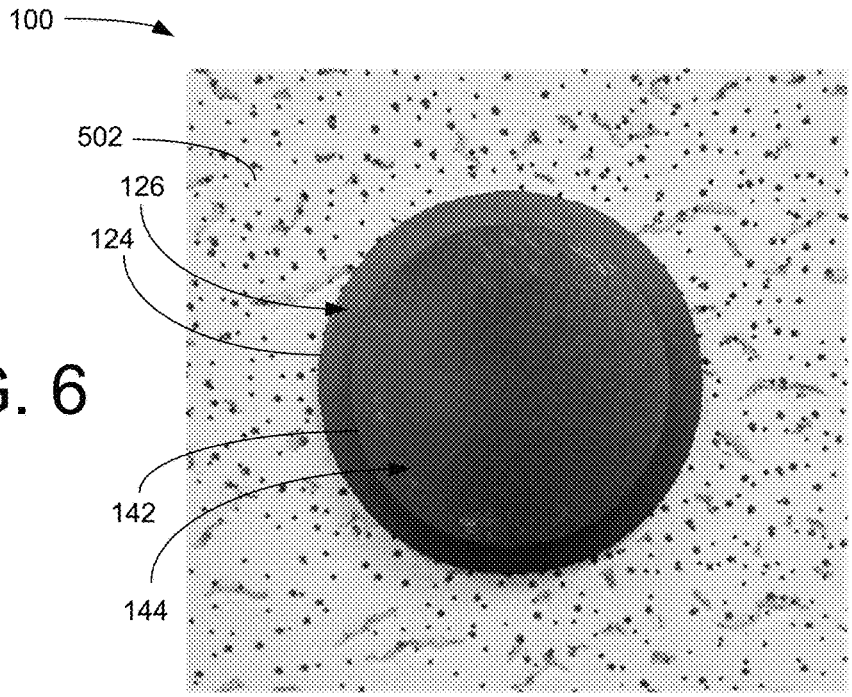
FIG. 6 is a bottom plan view illustrating the exemplary embodiment of the printable diffuser of FIG. 1, according to a preferred embodiment of the present invention.

FIG. 6 is a bottom plan view illustrating the exemplary embodiment of the printable diffuser 100 of FIG. 1, according to a preferred embodiment of the present invention. Steel ring 124 is shown with an unprinted surface 126 and disc cover plate 142 is shown with an unprinted surface 144.

Figure 7:
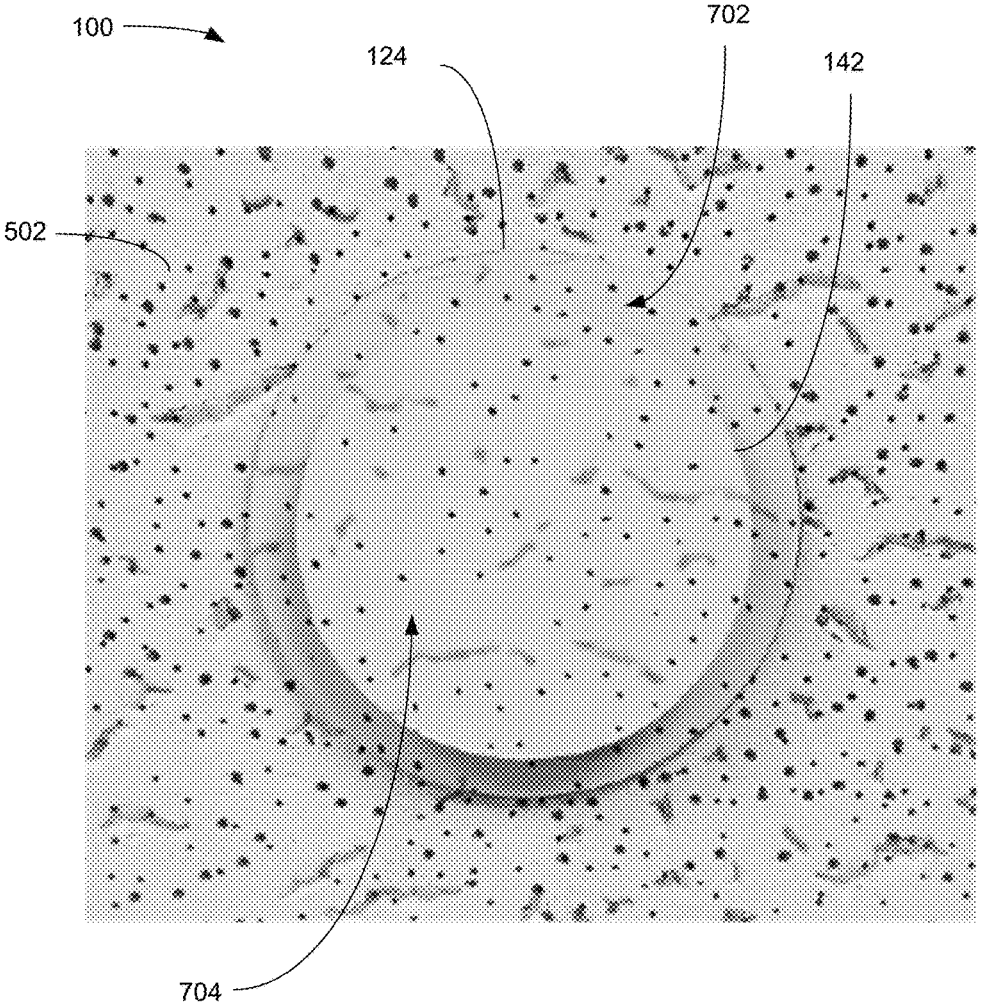
FIG. 7 is a bottom plan view illustrating the exemplary embodiment of the printable diffuser of FIG. 1, according to a preferred embodiment of the present invention.

FIG. 7 is a bottom plan view illustrating the exemplary embodiment of the printable diffuser 100 of FIG. 1, according to a preferred embodiment of the present invention. Surface 126 of steel ring 124 is covered over by printed pattern 702 and surface 144 of steel disc cover plate 142 is covered over by printed pattern 704. The randomness of the pattern of the ceiling tile 502 makes rotating steel ring 124 and disc cover plate 142 unnecessary, but still possible.

Figure 8:
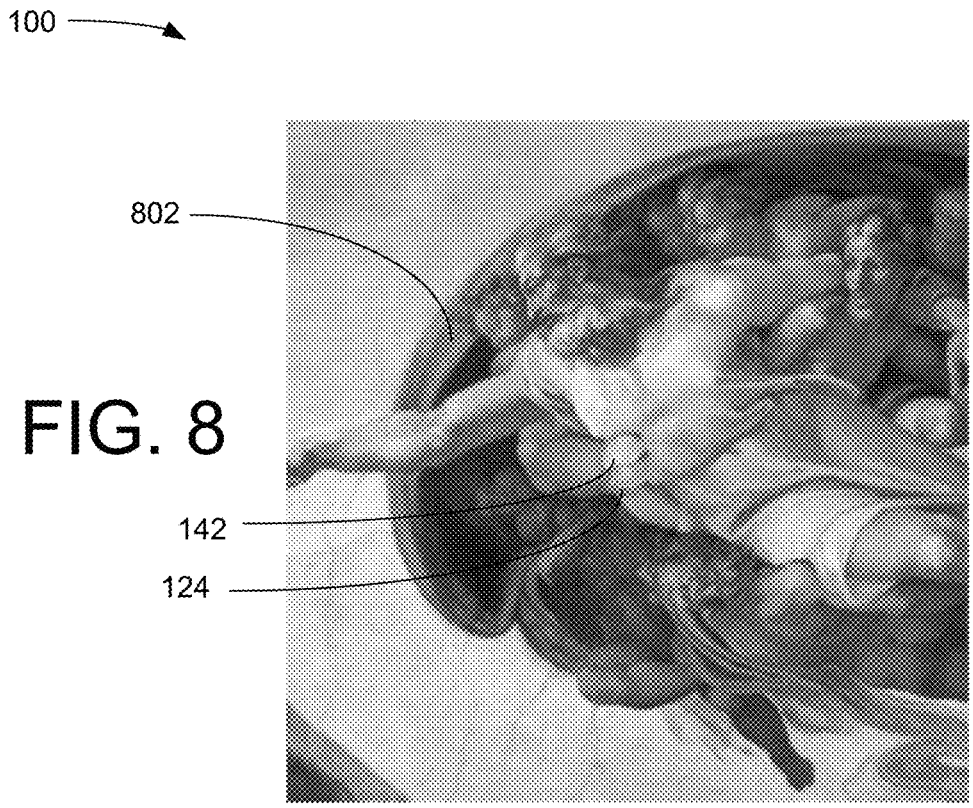
FIG. 8 is a bottom plan view illustrating the exemplary embodiment of the printable diffuser of FIG. 1, according to a preferred embodiment of the present invention.

FIG. 8 is a bottom plan view illustrating the exemplary embodiment of the printable diffuser 100 of FIG. 1, according to a preferred embodiment of the present invention. A complex pattern 802 includes printed steel ring 124 and printed disc cover plate 142. The steel ring 124 and the disc cover plate 142 have not been rotated, causing a discontinuity in the pattern 802.

Figure 9:
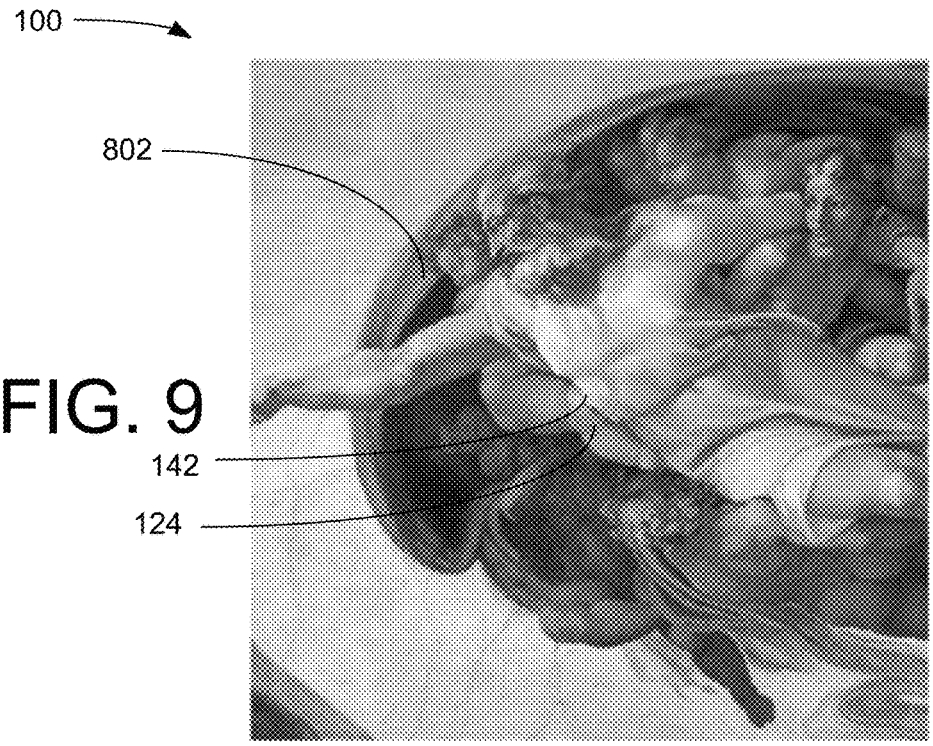
FIG. 9 is a bottom plan view illustrating the exemplary embodiment of the printable diffuser of FIG. 1, according to a preferred embodiment of the present invention.

FIG. 9 is a bottom plan view illustrating the exemplary embodiment of the printable diffuser 100 of FIG. 1, according to a preferred embodiment of the present invention. Here steel ring 124 and disc cover plate 143 have been rotated about a central vertical axis to align to the pattern 802 and to each other, thereby avoiding the discontinuity in the pattern 802.

Figure 10:
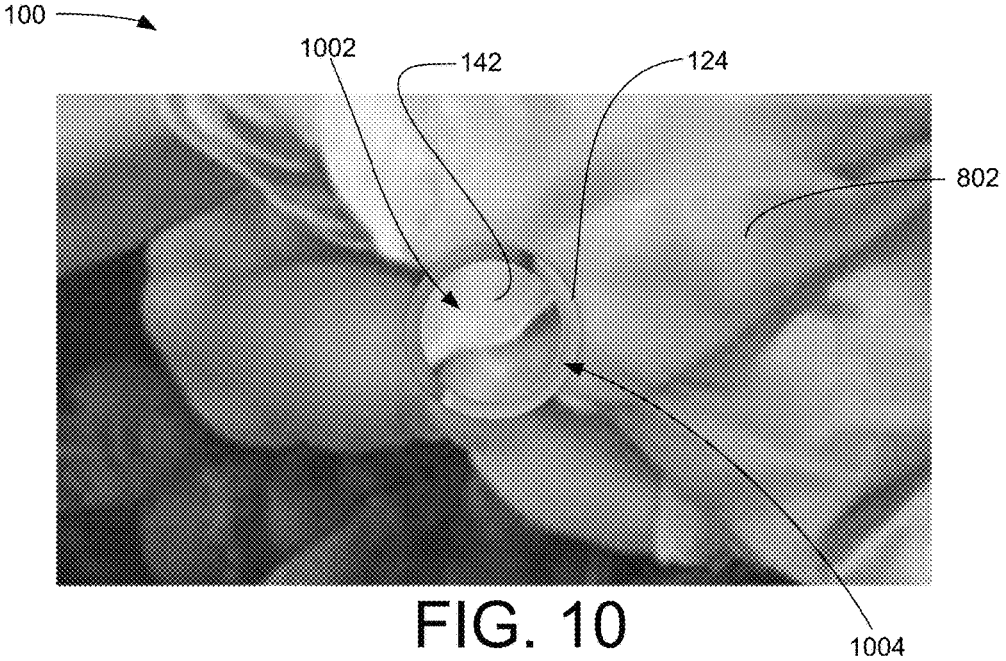
FIG. 10 is a bottom plan view illustrating the exemplary embodiment of the printable diffuser of FIG. 1, according to a preferred embodiment of the present invention.

FIG. 10 is a bottom plan view illustrating the exemplary embodiment of the printable diffuser 100 of FIG. 1, according to a preferred embodiment of the present invention. Steel ring 124 has pattern 1004 printed on its bottom surface 126 and steel disc cover plate 142 has pattern 1002 on its bottom surface 144. Steel ring 124 and steel disc cover plate 142 are shown not aligned to pattern 802 and not aligned to each other.

Figure 11:
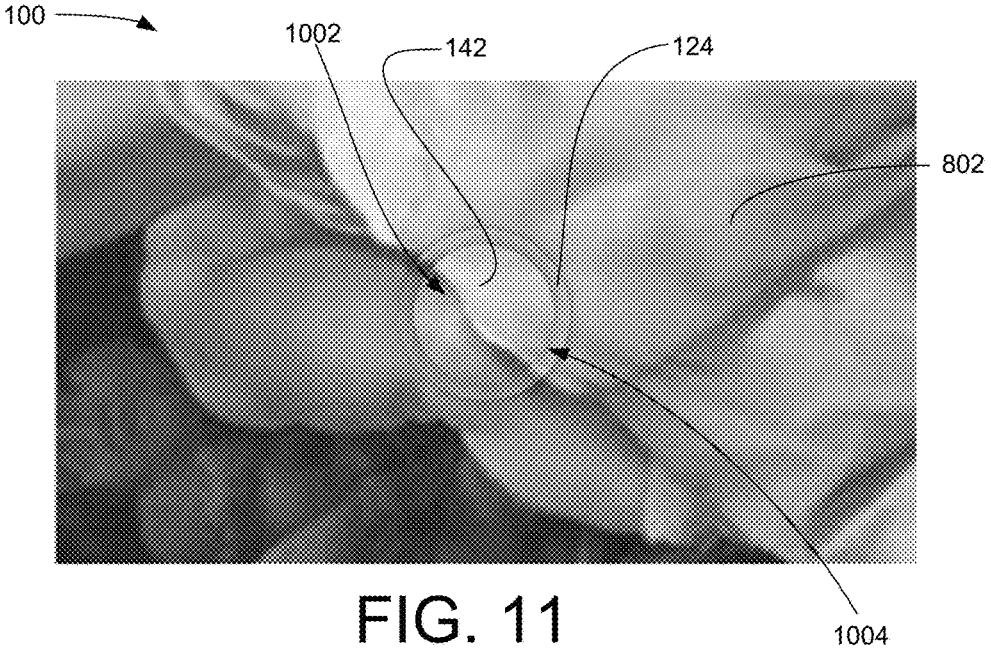
FIG. 11 is a bottom plan view illustrating the exemplary embodiment of the printable diffuser of FIG. 1, according to a preferred embodiment of the present invention.

FIG. 11 is a bottom plan view illustrating the exemplary embodiment of the printable diffuser 100 of FIG. 1, according to a preferred embodiment of the present invention. The effect of properly rotating steel ring 124 and steel disc cover plate 142 into alignment with the pattern 802 and with each other.

Figure 12:
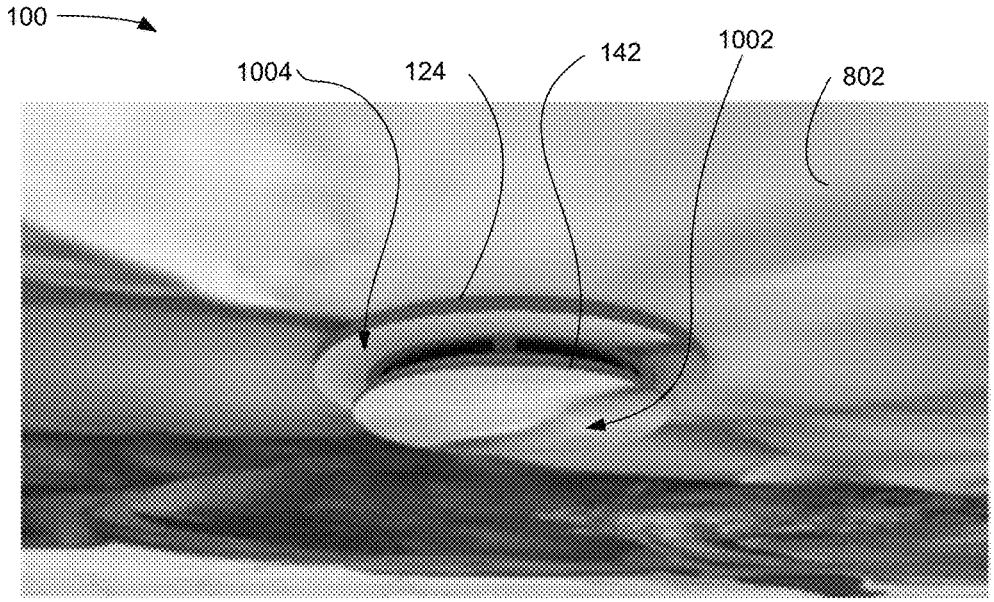
FIG. 12 is a bottom perspective view illustrating the exemplary embodiment of the printable diffuser of FIG. 1, according to a preferred embodiment of the present invention.

FIG. 12 is a bottom perspective view illustrating the exemplary embodiment of the printable diffuser 100 of FIG. 1, according to a preferred embodiment of the present invention. Steel ring 124 has pattern 1004 printed on its bottom surface 126 and steel disc cover plate 142 has pattern 1002 on its bottom surface 144. Steel ring 124 and steel disc cover plate 142 are shown not aligned to pattern 802 but are aligned to each other.

Figure 13:
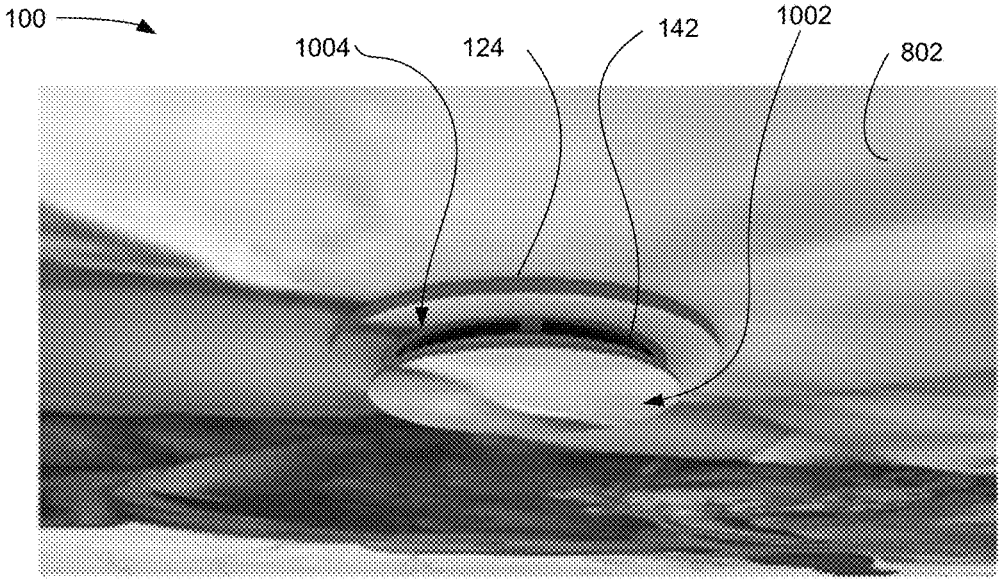
FIG. 13 is a bottom perspective view illustrating the exemplary embodiment of the printable diffuser of FIG. 1, according to a preferred embodiment of the present invention.

FIG. 13 is a bottom perspective view illustrating the exemplary embodiment of the printable diffuser of FIG. 1, according to a preferred embodiment of the present invention. The effect of properly rotating steel ring 124 and steel disc cover plate 142 into alignment with the pattern 802 and with each other.

The images for printing on steel ring 124 and steel disc cover plate 142 are preferably obtained by photography of the installation site prior to installation. Lighting and photographic techniques for getting true colors are preferably used. For three-dimensional printing, a scan of the ceiling surface using terrain mapping type techniques on a small scale is preferred. Indicators of the exact site and size of speaker installation are preferably added to the photographs or scans.

We claim:

1. A printable diffuser comprising:

a. a diffuser barrel having a bottom annular perimeter flange;

b. a plurality of magnets fixed to a bottom side of said bottom annular perimeter flange;

c. a magnetically-attracted ring operable to cover said bottom side of said bottom annular perimeter flange; and d. a printable surface on a bottom surface of said ring;

e. a diffuser body having a bottom side; and f. a rotational coupling between said diffuser barrel and said diffuser body.

2. The printable diffuser of claim 1, comprising printing on said printable surface of said ring.

3. The printable diffuser of claim 1, wherein said ring is manually rotatable about a central vertical axis of said diffuser.

4. The printable diffuser of claim 3, wherein:

a. said diffuser barrel has an inner rim extending downwardly;

b. said ring has an inner perimeter; and c. said inner rim and said inner perimeter are configured to slidingly rotationally engage.

5. The printable diffuser of claim 1, comprising a printing, on at least one of said printable surface of said ring and said printable surface of said disc, corresponding to a pattern on a ceiling.

6. The printable diffuser of claim 1 comprising:
a. s plurality of magnets fixed to said bottom side of said diffuser body;
b. a magnetically-attracted disc covering said bottom side;
c. a printable surface on a bottom surface of said disc and
d. wherein said rotational coupling comprises an axially central hub attached to said diffuser barrel via a plurality of spokes.

7. The printable diffuser of claim 6, comprising printing on said printable surface of said disc.

8. The printable diffuser of claim 6, wherein said disc is manually rotatable about a central vertical axis of said diffuser.

9. The printable diffuser of claim 8, wherein:
a. said disc has an upward extending circular ridge on a top side of said disc;
b. said diffuser body has a downwardly extending rim; and
c. said ridge and said rim are configured to slidingly rotationally engage.

10. The printable diffuser of claim 6, wherein said printing corresponds to at least one of:
a. a pattern on said ceiling; and
b. said printing on said printable surface of said ring.

11. A printable diffuser comprising:
a. a diffuser barrel having a bottom annular perimeter flange;
b. a plurality of magnets fixed to a bottom side of said bottom annular perimeter flange;
c. a magnetically-attracted ring covering said bottom side of said bottom annular perimeter flange;
d. a printable surface on a bottom surface of said ring;
e. printing on said printable surface of said ring;
f. first and second opposed sets of partial threads within said diffuser barrel.

12. The printable diffuser of claim 11, wherein:
a. said ring is manually rotatable about a central vertical axis of said diffuser;
b. said diffuser barrel has an inner rim extending downwardly;
c. said ring has an inner perimeter; and
d. said inner rim and said inner perimeter are configured to slidingly rotationally engage.

13. The printable diffuser of claim 11 comprising:
a. a diffuser body having a bottom side;
b. a plurality of magnets fixed to said bottom side of said diffuser body;
c. a magnetically-attracted disc covering said bottom side;
d. a printable surface on a bottom surface of said disc;
e. printing on said printable surface of said disc; and
f. wherein said first and second opposed sets of partial threads within said diffuser barrel each extend less than ninety degrees of angle along an internal surface of said diffuser barrel.

14. The printable diffuser of claim 13, wherein:
a. said disc is manually rotatable about a central vertical axis of said diffuser;
b. said disc has an upward extending circular ridge on a top side of said disc;
c. said diffuser body has a downwardly extending rim; and
d. said ridge and said rim are configured to slidingly rotationally engage.

15. The printable diffuser of claim 13, wherein said printing on said printable surface of said disc corresponds to at least one of:
a. a pattern on said ceiling; and
b. said printing on said printable surface of said ring.

16. The printable diffuser of claim 13, wherein said printing on said printable surface of said ring corresponds to at least one of:
a. a pattern on said ceiling; and
b. said printing on said printable surface of said disc.

17. A printable diffuser comprising:
a. a diffuser barrel having a bottom annular perimeter flange;
b. a plurality of magnets fixed to a bottom side of said bottom annular perimeter flange;
c. a magnetically-attracted ring covering said bottom side of said bottom annular perimeter flange;
d. a printable surface on a bottom surface of said ring;
e. a diffuser body having a bottom side;
f. a plurality of magnets fixed to said bottom side of said diffuser body;
g. a magnetically-attracted disc covering said bottom side; and
h. a printable surface on a bottom surface of said disc.

18. The printable diffuser of claim 17, wherein:
a. said ring is manually rotatable about a central vertical axis of said diffuser;
b. said diffuser barrel has an inner rim extending downwardly;
c. said ring has an inner perimeter;
d. said inner rim and said inner perimeter are configured to slidingly rotationally engage;
e. said disc is manually rotatable about a central vertical axis of said diffuser;
f. said disc has an upward extending circular ridge on a top side of said disc;
g. said diffuser body has a downwardly extending rim; and
h. said ridge and said rim are configured to slidingly rotationally engage.

19. The printable diffuser of claim 13, wherein:
a. said printing on said printable surface of said disc corresponds to at least one of:
i. a pattern on said ceiling; and
ii. said printing on said printable surface of said ring; and
b. said printing on said printable surface of said ring corresponds to at least one of:
iii. a pattern on said ceiling; and
iv. said printing on said printable surface of said disc.

20. A printable diffuser comprising:
a. a diffuser barrel having a bottom annular perimeter flange;
b. a plurality of magnets fixed to a bottom side of said bottom annular perimeter flange;
c. a magnetically-attracted ring covering said bottom side of said bottom annular perimeter flange;
d. a printable surface on a bottom surface of said ring;
e. a diffuser body having a bottom side;
f. a plurality of magnets fixed to said bottom side of said diffuser body;
g. a magnetically-attracted disc covering said bottom side;
h. a printable surface on a bottom surface of said disc;
i. wherein:
i. said ring is manually rotatable about a central vertical axis of said diffuser;
ii. said diffuser barrel has an inner rim extending downwardly;
iii. said ring has an inner perimeter;
iv. said inner rim and said inner perimeter are configured to slidingly rotationally engage;

v. said disc is manually rotatable about a central vertical axis of said diffuser;

vi. said disc has an upward extending circular ridge on a top side of said disc;

vii. said diffuser body has a downwardly extending rim; and viii. said ridge and said rim are configured to slidingly rotationally engage;

ix. said printing on said printable surface of said disc corresponds to at least one of:

1. a pattern on said ceiling; and
2. said printing on said printable surface of said ring; and x. said printing on said printable surface of said ring corresponds to at least one of:

1. a pattern on said ceiling; and
2. said printing on said printable surface of said disc.

* * * * *